US011524859B2

(12) United States Patent
Mattäß

(10) Patent No.: US 11,524,859 B2
(45) Date of Patent: Dec. 13, 2022

(54) METHOD FOR SPATIALLY ARRANGING COILS IN A COIL STORE, AND COMBINATION OF A PROCESSING MACHINE AND A COIL STORE

(71) Applicant: ASCO COILTECHNIK GMBH, Deutschland (DE)

(72) Inventor: Sylvio Mattäß, Deutschland (DE)

(73) Assignee: ASCO COILTECHNIK GMBH, Deutschland (DE)

( * ) Notice: Subject to any disclaimer, the term of this patent is extended or adjusted under 35 U.S.C. 154(b) by 305 days.

(21) Appl. No.: 16/756,717

(22) PCT Filed: Oct. 18, 2019

(86) PCT No.: PCT/EP2019/078353
§ 371 (c)(1),
(2) Date: Apr. 16, 2020

(87) PCT Pub. No.: WO2020/083769
PCT Pub. Date: Apr. 30, 2020

(65) Prior Publication Data

US 2021/0205869 A1 Jul. 8, 2021

(30) Foreign Application Priority Data

Oct. 22, 2018 (DE) ..... 10 2018 218 021.0

(51) Int. Cl.
*B65H 19/12* (2006.01)
*B21C 47/26* (2006.01)

(52) U.S. Cl.
CPC ..... *B65H 19/126* (2013.01); *B65H 19/12* (2013.01); *B21C 47/26* (2013.01);
(Continued)

(58) Field of Classification Search
CPC ..... B65H 19/12; B65H 19/126; B65H 2301/41522; B65H 2301/41702; B65H 2511/142; B65H 2701/173
See application file for complete search history.

(56) References Cited

U.S. PATENT DOCUMENTS 3,415,459 A 12/1968 O'Brien
4,386,741 A * 6/1983 Weiss ..... B65H 19/126 242/559.3

(Continued)

FOREIGN PATENT DOCUMENTS

AT 501843 A1 11/2006
CH 664309 A5 2/1988

(Continued)

OTHER PUBLICATIONS

German Application No. DE102018218021.0 "Search Report", dated Oct. 4, 2019, 10 pages.
International Application No. PCT/EP2019/078353, "International Search Report and Written Opinion", dated Feb. 4, 2019, 2 pages.

*Primary Examiner* — Sang K Kim
(74) *Attorney, Agent, or Firm* — Kilpatrick Townsend & Stockton LLP

(57) ABSTRACT

Method for spatially arranging coils, the method comprising: providing electronic data about an initial storage state, which electronic data contains information about a respective initial diameter of the coils and a respective initial spatial storage position of the coils in a coil store; transporting a selected coil from an initial storage position to a processing machine for processing at least a portion of the sheet metal of the selected coil; sensing a reduced diameter of the selected coil after the portion of the sheet metal has been removed from the selected coil for processing by the processing machine; storing the reduced diameter of the selected coil; transporting the selected coil having the reduced diameter to a depositing storage position which,
(Continued)

Figure 1:
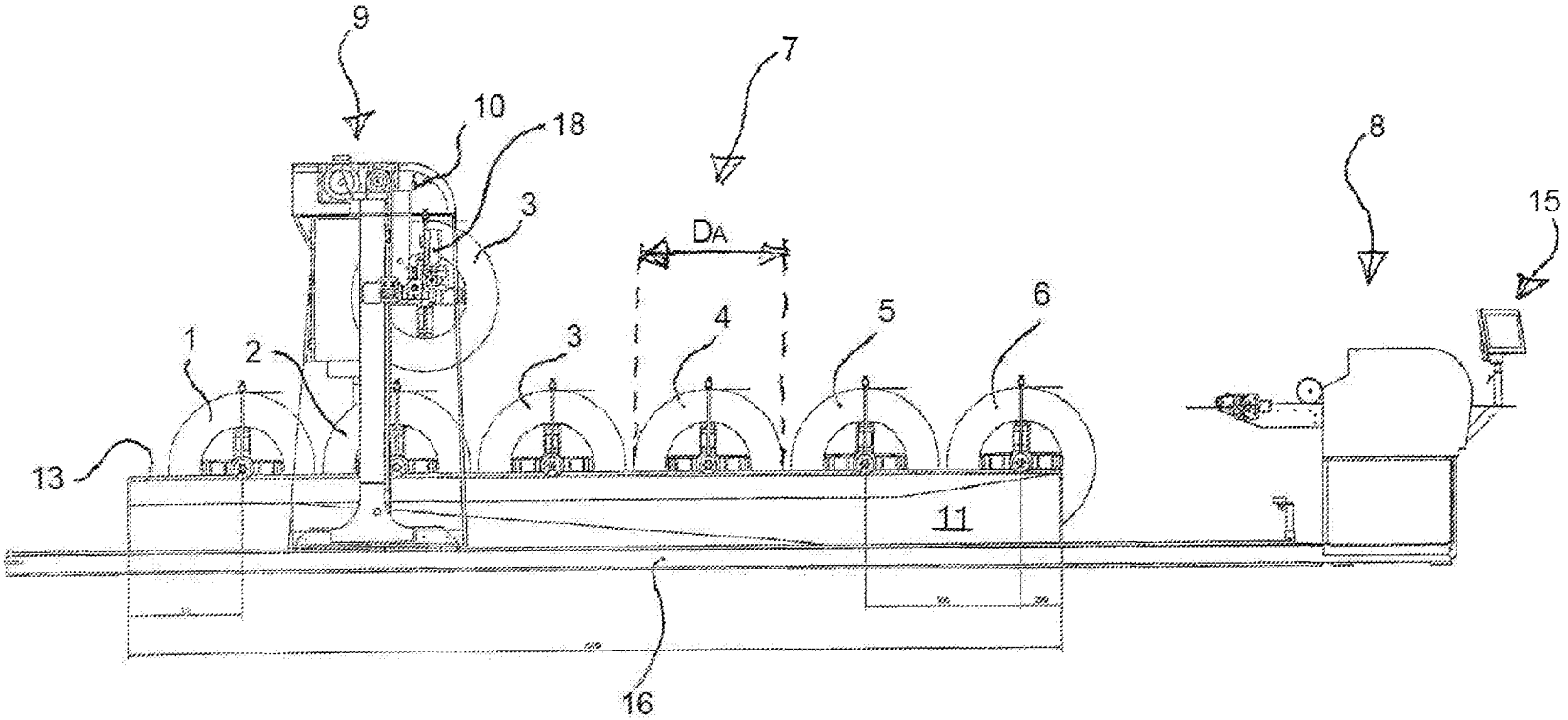

depending on the reduced diameter, is selected to differ from the initial storage position in a manner that saves storage space; and storing the depositing storage position.

8 Claims, 6 Drawing Sheets

(52) U.S. Cl.
CPC ..... *B65H 2301/4134* (2013.01); *B65H 2301/41522* (2013.01); *B65H 2301/41702* (2013.01); *B65H 2301/41734* (2013.01); *B65H 2405/422* (2013.01); *B65H 2511/14* (2013.01); *B65H 2701/173* (2013.01)

(56) References Cited

U.S. PATENT DOCUMENTS

| | | | | |
|---|---|---|---|---|
| 2006/0000940 | A1* | 1/2006 | Frey | B65H 19/126 242/559.3 |
| 2018/0141772 | A1* | 5/2018 | Prankl | B65H 19/12 |

FOREIGN PATENT DOCUMENTS

| | | | |
|---|---|---|---|
| CN | 104117551 | B | 6/2016 |
| EP | 1626823 | B1 | 7/2007 |
| JP | H0829015 | A | 2/1996 |
| JP | H08290215 | A | 11/1996 |

* cited by examiner

METHOD FOR SPATIALLY ARRANGING COILS IN A COIL STORE, AND COMBINATION OF A PROCESSING MACHINE AND A COIL STORE

CROSS REFERENCE TO RELATED APPLICATION

This application claims priority to German Patent Application No. 10 2018 218 021.0, filed in Germany on Oct. 22, 2018, the entire contents of which are hereby incorporated herein by this reference.

I. FIELD OF APPLICATION

The present invention relates to a method for spatially arranging coils in a coil store, and to a combination of a processing machine and a coil store. A coil in the sense of the present application is understood to be a reel of sheet metal, i.e. a reel onto which sheet metal is wound in the form of web material. The processing machine can be, for example, a sheet metal cutting machine, a sheet metal bending machine, a sheet metal punching machine or any other sheet metal processing machine.

II. TECHNICAL BACKGROUND

Sheet metal processing companies usually process various types of orders from their customers. The various types of orders regularly require sheets of different thicknesses and/or different material compositions to be processed. In terms of quantity, the individual orders are usually never so extensive that the processing machine processes all of the sheet metal, which is wound in the form of a coil and has a certain thickness and/or composition, in a single operation. Rather, depending on the order, the processing machine must sometimes be supplied with one type of sheet metal and sometimes with another type of sheet metal for processing.

Against this background, it is known to provide a so-called coil store for a processing machine for processing sheet metal, in which coil store coils made of different sheet metals, for example sheet metals having different thicknesses, are kept ready.

A known coil store is described, for example, in EP 1 626 823 B1. Here, fixed bearing blocks are proposed for storing the coils in fixed storage locations. The result of the fixed storage locations is that, regardless of how much sheet metal has already been drawn from the individual coils for processing, the space requirement of the coils in the coil store remains substantially constant over the service life of the processing machine. The increasing variety of sheet thicknesses and sheet types to be processed in practice therefore means that more storage space must be made available for the coil store if sheet thicknesses or sheet types that are not yet available in the coil store are to be processed.

III. DESCRIPTION OF THE INVENTION a) Technical Object

It is therefore the object of the present invention to provide a method for spatially arranging coils in a coil store, and to provide a combination of a processing machine and a coil store for keeping a plurality of coils ready for processing the sheet metal of the coils by means of the processing machine, which method and combination allow the storage of coils having as many different sheet thicknesses and/or sheet types as possible in the smallest possible space.

b) Achieving the Object

This object is achieved by a method having the features of claim 1, and by a combination of a processing machine and a coil store having the features of claim 3. Further features of the present invention follow from the dependent claims.

According to the invention, a method is proposed for spatially organising or arranging coils in a coil store in which a plurality of coils can be stored, the method comprising the following steps:

a) providing electronic data about an initial storage state, which electronic data contains information about a respective initial diameter of all the coils and about a respective initial spatial storage position of all the coils in the coil store;

b) transporting a selected coil having a specific sheet thickness and/or a specific sheet composition from its initial storage position to a processing machine for processing a portion of the specific sheet metal of the selected coil;

c) sensing a reduced diameter of the selected coil after the portion of the sheet metal of the selected coil has been removed or unwound from the selected coil for processing by the processing machine such that the amount of sheet metal remaining on the selected coil is decreased by the sheet metal portion that is to be processed or was processed by the processing machine;

d) electronically storing the reduced diameter of the selected coil;

e) transporting the selected coil having the reduced diameter to a depositing storage position which, depending on the reduced diameter of the selected coil, is selected by an electronic, programmed system controller to differ from its initial storage position in a manner that saves storage space such that the distance between a coil axis of the selected coil and a coil axis of a coil adjacent to the selected coil in the coil store is less in the depositing storage position than in the initial storage position; and f) electronically storing the depositing storage position of the selected coil.

The above sequence of steps a) to f) does not necessarily correspond to the chronological order of steps to be followed during the course of the method according to the invention. As far as permitted by the technical context of the method, a different chronological order of the method steps can easily be chosen. For example, it is conceivable to carry out storage steps d) and f) simultaneously after transport step e). Because the data of the depositing storage position can be calculated from the reduction in the diameter of the selected coil and its previous initial storage position even before the selected coil is actually transported to the depositing storage position according to step e), it would also be possible, if necessary, to perform storage steps d) and f) before the actual transport according to step e).

While various types of sheet metal are processed using the processing machine, it is precisely the coil having the sheet metal to be processed (selected coil) that is transported to the processing machine. A portion of the sheet metal is then unwound from the selected coil and processed in the processing machine. The selected coil is then transported back to the coil store where it waits for the next order which, in order to be processed, requires precisely the sheet metal of this selected coil. As a result, the diameters, or more precisely the outer diameters, of all the coils in the coil store decrease sooner or later to a greater or lesser extent as the sheet metal processing continues. The method according to the invention cleverly uses the increasing amount of free space that arises between the individual coils as storage space for coil storage.

The method according to the invention is carried out with the aid of an electronic, programmed system controller. Said controller stores the initial diameters, which may be differently sized, of all the coils as well as the spatial position coordinates of the initial storage positions of all the coils in the coil store. The initial storage positions can be stored, for example, in the form of the respective spatial coordinate of the coil axis of each coil.

If there is an order to process the sheet metal of the selected coil, said coil is transported to the processing machine and a portion of the sheet metal thereof is processed. The reduced diameter of the selected coil is electronically sensed by the system controller with the aid of a sensor, preferably an optical laser sensor.

After the selected coil has been transported from the processing machine back to the coil store, the coil is not deposited in the initial storage position that it had assumed before it was collected for processing the order. Instead, the system controller calculates a depositing storage position that differs from the initial storage position, the reduced diameter of the coil being included in the calculation of the depositing storage position. Due to the reduced diameter of the selected coil, the coil axis thereof can be arranged closer to the coil axis of an adjacent coil.

This arrangement of the selected coil having a reduced diameter closer to an adjacent coil takes place, for example, in such a way that the coil axis of the selected coil is offset from its initial storage position by half the reduction in its diameter in the direction of the adjacent coil. In this case, the distance between the cylindrical outer surfaces of the deposited, selected coil and the coil adjacent thereto is as great as it was when the selected coil still had its larger initial diameter and was still arranged in its initial storage position. In this way, the coil selected and transported back to the coil store preferably spatially moves up in the row of coils located in the coil store, preferably in the direction of the processing machine.

After a sheet metal processing order has been processed and the selected coil has been transported back to the depositing storage position in the coil store, the electronic system controller can store the reduced diameter of the selected coil and the spatial coordinates of the depositing storage position as a new initial storage state in the sense of process step a). The next cycle of steps b) to f) of the method according to the invention can then be carried out on the basis of this new initial storage state.

With each further sheet metal processing order, a cycle according to steps b) to f) takes place repeatedly such that the stored coils spatially advance or move together in the coil store. As soon as there is enough space for an additional coil in the coil store, the spatial external dimensions of which remain the same, said additional coil can additionally be put into the coil store. The coil store then holds one more coil than it had held in the original initial storage state. The additional coil can, in particular, be made of a sheet metal whose sheet thickness and/or sheet type was not yet present in the original initial storage state.

The transporting according to steps b) and e) takes place by means of a coil transport device, which is preferably a coil lifting device. Said coil transport device lifts the selected coil above the coils remaining in the store, transports them to the processing machine in a translatory manner and finally unwinds the portion of the sheet metal to be processed by the processing machine from the selected coil. Said device is particularly advantageous because no separate unwinding device to which the selected coil would have to be transferred has to be arranged in the region of the processing machine. The coil transport device, which also assumes the function of unwinding, thus avoids a mechanical transfer step for the coil to be unwound and thus an associated risk of malfunctions during a transfer operation.

According to the invention, a device is also proposed in the form of a combination of a processing machine and a coil store for keeping a plurality of coils ready for the processing of the sheet metal of the coils by means of the processing machine. Said device comprises a holding device arranged in the coil store for holding all the coils in storage at any point on the holding device. An electronic memory device is provided in which electronic data about an initial storage state can be stored, this data containing information about a respective initial diameter of the coils and a respective initial spatial storage position of the coils in the coil store. The initial spatial storage position is stored, for example, in the form of the spatial coordinates of the coil axis of each coil.

A coil transport device transports a selected coil from its initial storage position at a first point on the holding device to the processing machine for processing a portion of the sheet metal of the selected coil. The selected coil then has a reduced diameter, more precisely a reduced outer diameter. The coil transport device can also transport the selected coil having the reduced diameter to a second point on the holding device that forms a depositing storage position and differs from the first point on the holding device and, depending on the reduced diameter of the selected coil, is selected by the electronic system controller in a manner that saves storage space such that the distance between a coil axis of the selected coil and a coil axis of a coil adjacent to the selected coil in the coil store is smaller in the depositing storage position than in the initial storage position.

There is also a sensor device for sensing the reduced diameter of the selected coil, the sensing of the reduced diameter taking place after the portion of the sheet metal of the selected coil has been removed from the selected coil for processing by the processing machine. The sensor device is preferably an optical laser sensor that has electronic signal connection to the system controller.

The coil transport device advantageously has an unwinding device for unwinding the portion of the sheet metal of the selected coil to be processed in the direction of the processing machine.

Preferably, the holding device for holding all the coils in storage comprises two elongated bearing supports, each having a horizontally extending, elongated upper edge. The bearing supports are spaced apart from one another in such a way that all the coils can be stored at any point on the two horizontal upper edges to keep them ready for the processing machine with the aid of axle stubs protruding from the end faces thereof, or alternatively with the aid of two bolts attached to the coil transport device, which bolts can engage in end plates on the reels of the coils. These arbitrary points along the upper edges form a geometrically continuous plurality of bearing points at which the coils can be stored. There is no restriction in the bearing points which can be approached by the coil transport device by means of discretely spaced bearing blocks or similar.

The sensor device for sensing the reduced diameter of the selected coil is advantageously arranged on the coil transport device.

c) Embodiment

Figure 2:
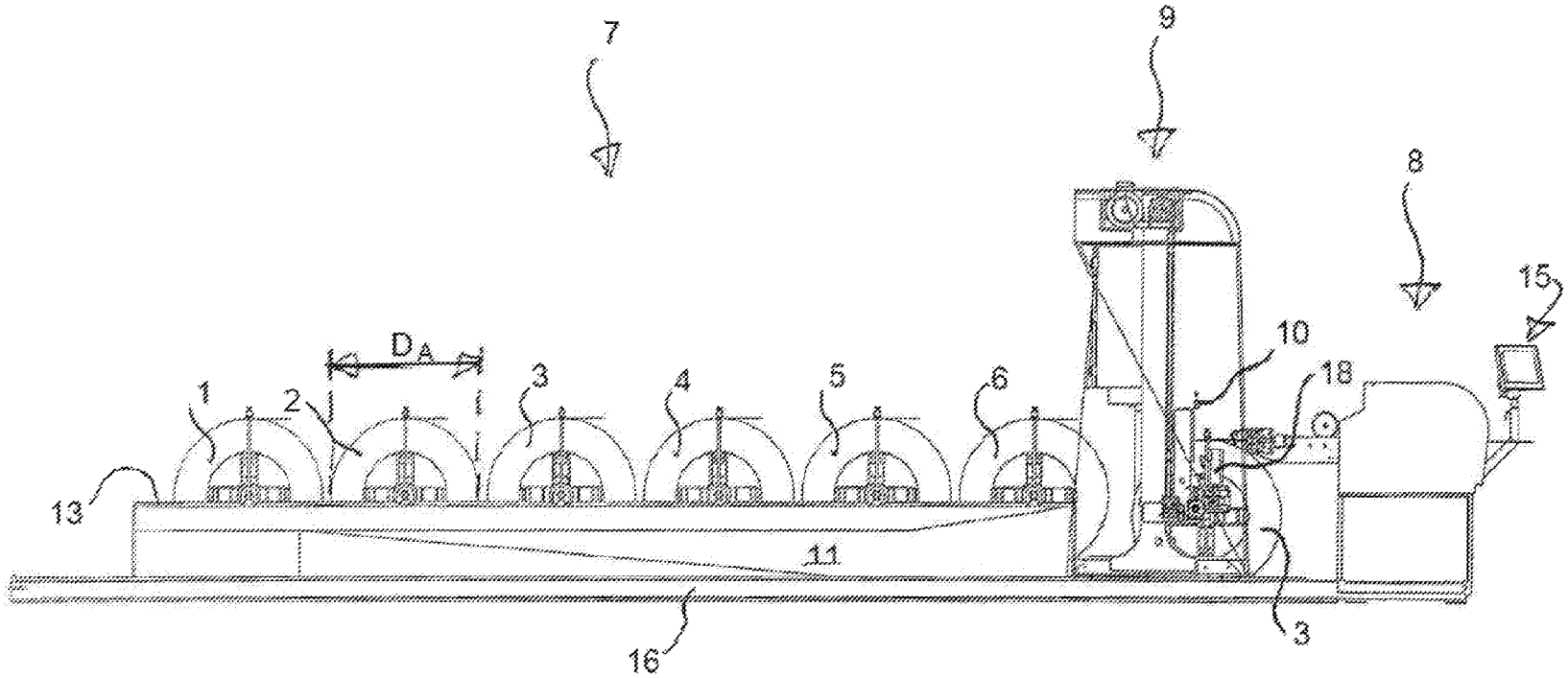
Figure 3:
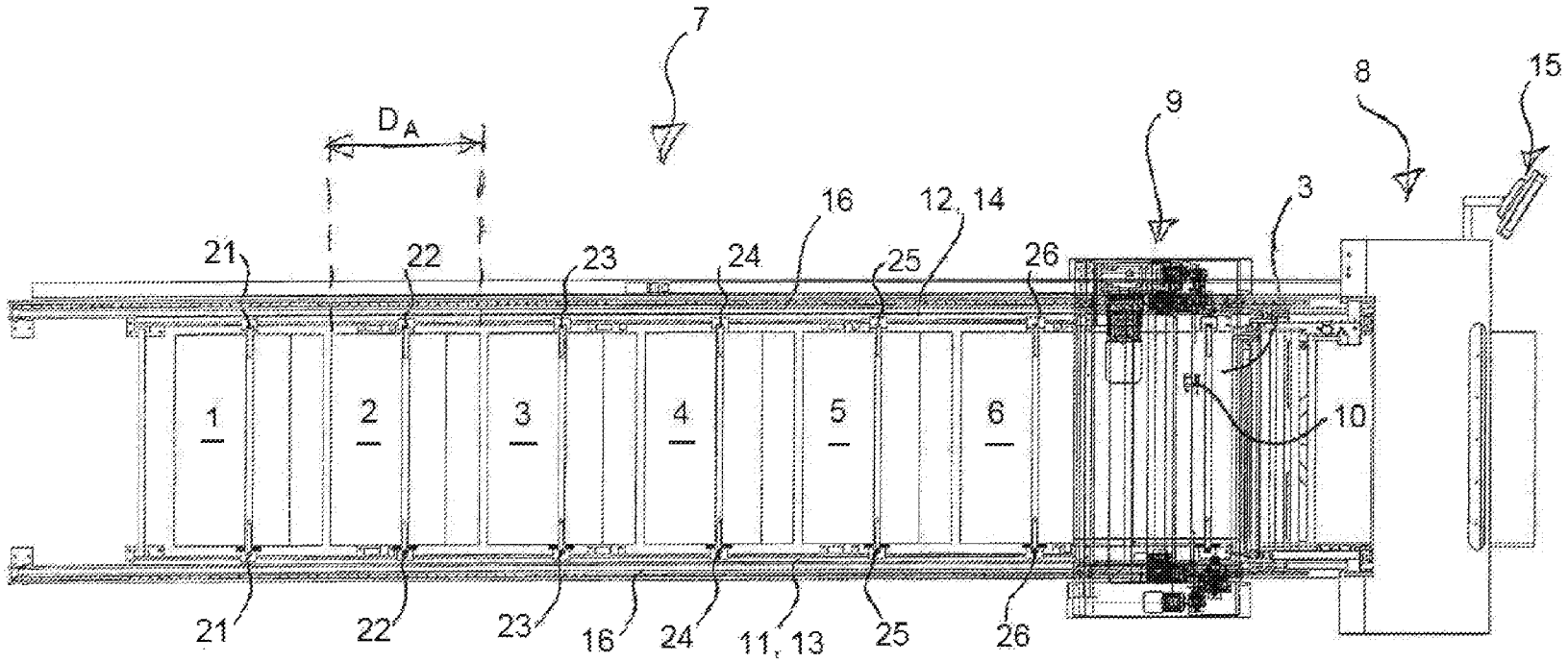
Figure 4:
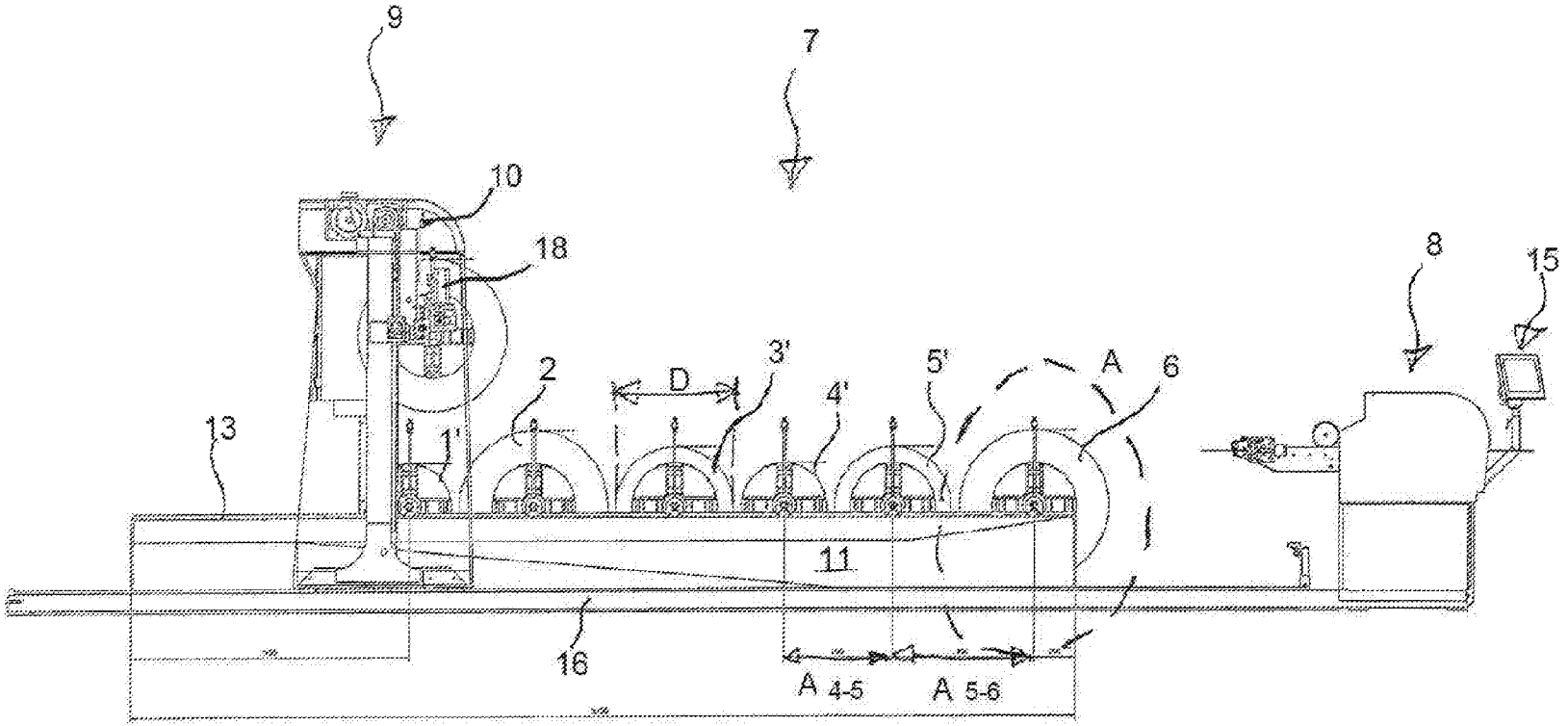

An embodiment of the combination of processing machine and coil store according to the invention in connection with the method according to the invention will be described below by way of example with reference to the accompanying drawings. In the drawings:

FIG. 1: is a side view of an embodiment of a combination according to the invention, the coil store being in an original initial storage state;

FIG. 2: is a side view similar to FIG. 1, the coil transport device having transported a selected coil to the processing machine;

FIG. 3: is a view from above of the combination shown in FIG. 2;

FIG. 4: is a side view similar to FIG. 1, the coil store being in a state reached by the continued processing of sheet metal.

Figure 5:
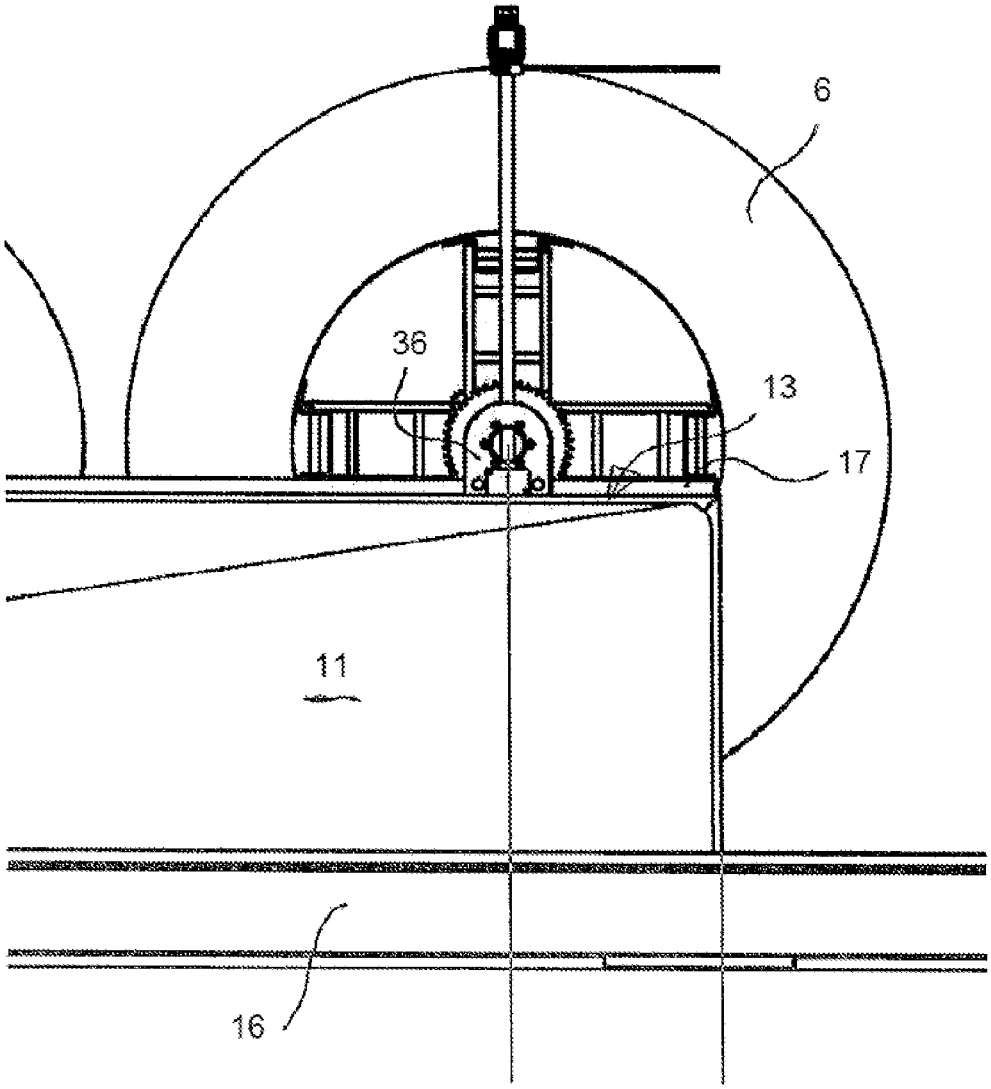

FIG. 5: is an enlarged view of the detail A denoted in FIG. 4.

Figure 6:
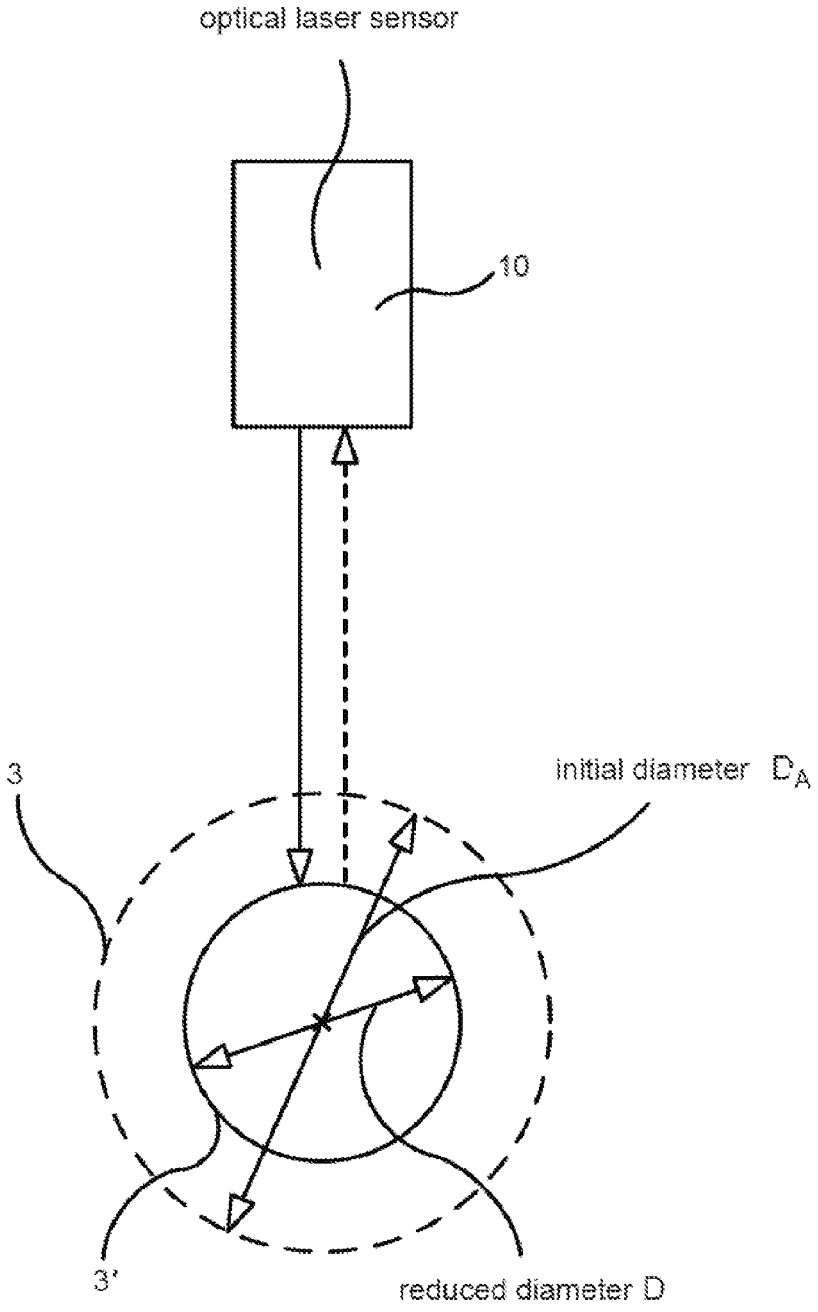

FIG. 6: illustrates a sensor device performing a distance measurement for sensing the reduced diameter D of a selected coil.

FIG. 1 is a side view of an embodiment of a coil store 7 and a processing machine 8 for processing the sheet metal wound in the form of coils 1, 2, 3, 4, 5 and 6. Coils 1, 2, 3, 4, 5 and 6 contain coiled sheet metal having different sheet thicknesses and/or different sheet compositions. The processing machine 8 by way of example is a slitting and cross-cutting system for slitting and cross-cutting sheet metal. An electronic, programmed system controller can be operated by an operator of the processing machine 8 with the aid of an operating unit 15.

In FIG. 1, the coil store 7 is in an original initial storage state in which all six coils 1, 2, 3, 4, 5 and 6 each comprise an original initial sheet metal quantity. In the embodiment shown, they all have the same initial diameter $D_A$ which, in FIG. 1, is only shown by way of example for coil 4. Of course, two, some or all of coils 1, 2, 3, 4, 5 and 6 can also have different initial diameters in the initial storage state.

Furthermore, a coil transport device in the form of a portal-like coil lifting device 9 can be seen that, in FIG. 1, can be moved by a motor from left to right or right to left on running rails 16. The coil lifting device 9 can lift a coil in a manner known per se and can move it over other coils in the horizontal direction in FIG. 1. The coil lifting device 9 includes a sensor device 10 for sensing the reduced diameter of the selected coil and an unwinding device 18 for unwinding a portion of the sheet metal of the selected coil to be processed in the direction of the processing machine 8.

An exemplary order of the processing machine 8 is to cut sheet metal with exactly the sheet thickness that is wound on the coil 3. Accordingly, the operator has entered this at the operating unit 15. The electronic system controller accordingly controls the coil lifting device 9 in such a way that it moves towards the initial storage position of the coil 3 selected for processing the order, as shown in FIG. 1. It can be seen in FIG. 1 that the coil lifting device 9 has already raised the selected coil 3 (for illustration purposes only, the coil lifting device 9 together with the lifted coil 3 are shown in FIG. 1 to the left of the initial storage position of the coil 3).

In FIG. 1, the coil lifting device 9 now transports the selected coil 3 to the right and over coils 4, 5 and 6 until it has reached its unwinding position (shown in FIG. 2) just in front of the processing machine 8. As can be seen in FIG. 2, the coil lifting device 9 has already lowered the selected coil 3 into an unwinding position for unwinding the sheet metal into the processing machine 8. In FIG. 2, the initial diameter $D_A$ is marked on coil 2.

The coil lifting device 9 is provided with an unwinding device 18 known per se (not shown in greater detail) that, in FIG. 2, unwinds the selected coil 3 in a clockwise direction in such a way that the unwound sheet metal reaches the processing machine 8 for cutting. The unwinding device is thus not arranged in a stationary manner, but always moves together with the coil lifting device 9. The coil lifting device 9 thus performs the functions of lifting and lowering the coils, translationally transporting the coils in the horizontal direction and unwinding a coil required at the processing machine 8.

Between picking up the selected coil 3 from its initial storage position, unwinding the selected coil 3 in the region of the processing machine 8 and returning the selected coil 3' having a reduced diameter D (see FIG. 4) to its position differing from the initial storage position, coil 3 or 3' is thus not released by the coil lifting device 9. This is advantageous because no transfer to a stationary unwinding device is required, as in the prior art. An associated transfer risk of a mechanical malfunction and the associated transfer time for transferring the coil to the stationary unwinding device are thereby avoided.

In FIG. 3, the coil store 7 shown in FIG. 2, the processing machine 8 and the coil lifting device 9 (including the sensor device 10) can be seen in a top view. Identical reference signs to those in FIG. 2 denote identical parts.

After a portion of the sheet metal wound on the selected coil 3 has been fed to the processing machine 8 as a sheet metal web and the sheet metal processing order for the specific sheet metal according to coil 3 has been processed, coil 3' has a diameter D that is reduced in comparison to its initial diameter $D_A$, which is shown in FIG. 4. Coil 3' having the reduced diameter D thus takes up less space than coil 3 having the initial diameter $D_A$.

The electronic system controller is programmed in such a way that it causes coil 3, 3' to be transported back from its unwinding position shown in FIGS. 2 and 3 with the aid of the coil lifting device 9 in such a way that coil 3' is not deposited back at its original initial storage position. Instead, coil 3' is deposited at a depositing storage position that is closer to coil 4 in FIGS. 2 and 3. The coil axis of coil 3' deposited in the coil store 7 again is accordingly closer to the coil axis of coil 4. Coil 3' is, in comparison with FIGS. 2 and 3 on the one hand and FIG. 4 on the other hand, moved slightly to the right in the direction of processing machine 8. This results initially in a greater distance between the cylindrical outer surfaces of coils 3' and 2 in FIGS. 2-4 when coil 3' is imagined to be deposited at its depositing storage position according to the invention, but is later reduced when the method according to the invention is carried out repeatedly.

For example, if sheet metal of coil 2 is to be processed as part of the next sheet metal processing order, coil 2 becomes the 'selected coil' in the sense of the method according to the invention. After this order is completed, coil 2 now also has a reduced diameter and is transported back into the coil store 7 by the coil lifting device 9. In this case, the depositing storage position of coil 2 can be calculated by the system controller in such a way, for example, that the coil axis of coil 2, compared to its initial storage position, moves to the right towards coil 3' in FIGS. 2-4 by the sum of half the diameter reduction of coil 2 and half the diameter reduction of coil 3' required in the previous sheet metal processing order.

FIG. 4 shows the state of the coil store 7 after the processing machine 8 has carried out a large number of sheet metal processing orders. As can be seen, coils 2 and 6 in this snapshot still have their initial diameter $D_A$, which is shown in FIGS. 1 and 2. Coils 1', 3', 4' and 5' have significantly reduced diameters compared to their respective initial diameters $D_A$. A reduced diameter D is shown by way of example for the selected coil 3'.

Each time the method according to the invention is carried out, the coil axis of the coil selected in each case for a processing order moves to the right in FIGS. 1 to 4 by the amount of half the diameter reduction caused by the unwinding of sheet metal required for processing the order. As a result, as is shown in FIG. 4, a state is repeatedly achieved in which the distances between the cylindrical outer surfaces of adjacent coils are constant. In contrast, the distances of the coil axes of adjacent coils are generally not equidistant because the coils located in the coil store 7 generally have diameters of different sizes. For example, the axial distance $A_4$-5 between the coil axes of coils 4 and 5 shown in FIG. 4 is significantly smaller than the axial distance $A_5$-6 of the coil axes of coils 5 and 6 shown in FIG. 4.

In FIG. 4, to the left of the coil 1', the gain in space for storing additional coils can be seen and results from the multiple executions of the method according to the invention.

In the exemplary illustration in FIG. 4, coil 2 is shown with its initial diameter $D_A$ and, despite this, in a depositing storage position moved to the right. The system controller can be programmed in such a way that a scanner unit provided on the coil lifting device 9 can electronically enter the geometric state of the coil store 7 into the system controller as required. Coils not required for a processing order for a given, relatively long period of time, in this case coil 2, are then moved by the coil lifting device 9 to the right in FIGS. 1-4 in the sense of clearing the coil store 7, without approaching the processing machine 8 with the coil in question.

In FIGS. 1 to 4, two elongated bearing supports 11 and 12 can be seen in the form of elongated bearing walls. Said supports form the holding device for holding all the coils in storage in the coil store 7 in the sense of the present invention. The wall-like bearing supports 11 and 12 have horizontally extending upper edges 13 and 14 on which coils 1, 2, 3, 4, 5 and 6 can be deposited at any point provided that, at the corresponding point, there is no fear of a mechanical collision between the coil to be deposited and other coils that are already being stored.

FIG. 5 shows an enlarged representation of the detail A identified in FIG. 4. In particular, a portion of the upper edge 13 of the wall-like bearing support 11 can clearly be seen. A rear grip bar 17 protrudes upwards from the narrow upper edge 13 on the rear side of the wall-like bearing support 11 in the viewing direction of FIG. 5. Said rear grip bar 17 can be gripped from above by a bearing shoe 36 that supports the axle stub 26, marked in FIG. 3, of coil 6. The bearing shoe 36 is an example for all the other axle stubs 21, 22, 23, 24 and 25, marked in FIG. 3, of coils 1, 2, 3, 4 and 5. The upper edge 14 of the wall-like bearing support 12 opposite the wall-like bearing support 11 has a rear grip bar that is not visible in FIG. 5 and is designed and arranged analogously to the rear grip bar 13.

As can be seen in FIG. 3, the upper edges 13 and 14 of the wall-like bearing supports 11 and 12 run in a straight line parallel to one another and are spaced apart such that the coil lifting device 9 can always mount the coils in such a way that the bearing shoes (see the bearing shoe 36 in FIG. 5) of coils 1, 2, 3, 4, 5 and 6 grip behind the rear grip bars (see the rear grip bar 17 in FIG. 5) along the upper edges 13 and 14 and thereby secure the coils on the bearing supports 11 and 12 in the axial direction in a positive-locking manner.

FIG. 6 illustrates the sensor device 10 (e.g., by using an optical laser sensor) performing a distance measurement for sensing the reduced diameter D of the selected coil 3'. The distance measurement can indicate the initial diameter $D_A$ of the selected coil 3 and the reduced diameter D of the selected coil 3'. As explained herein above, a portion of the sheet metal wound on the selected coil 3 has been fed to the processing machine 8 as a sheet metal web and the sheet metal processing order for the specific sheet metal according to coil 3 has been processed, coil 3' has a diameter D that is reduced in comparison to its initial diameter $D_A$.

LIST OF REFERENCE SIGNS

1 Coil
1' Coil 1 with a reduced diameter
2 Coil
3 Selected coil
3' Selected coil 3 with a reduced diameter D
4 Coil
4' Coil 4 with a reduced diameter
5 Coil
5' Coil 5 with a reduced diameter
6 Coil
7 Coil store
8 Processing machine
9 Coil lifting device
10
11 Bearing support
12 Bearing support
13 Upper edge of bearing support 11
14 Upper edge of bearing support 12
15 Control unit
16 Running rail of coil lifting device 9
17 Rear grip bar
21 Axle stub of coil 1
22 Axle stub of coil 2
23 Axle stub of coil 3
24 Axle stub of coil 4
25 Axle stub of coil 5
26 Axle stub of coil 6
36 Bearing shoe of coil 6
$D_A$ Initial diameter
D Reduced diameter of coil 3'
$A_{4-5}$ Axial distance between coil axes of coils 4 and 5
$A_{5-6}$ Axial distance between coil axes of coils 5 and 6

The invention claimed is:

1. A method for spatially arranging coils in a coil store in which a plurality of coils can be stored, the method comprising the following steps:

providing electronic data about an initial storage state, which electronic data contains information about a respective initial diameter ($D_A$) of the coils and a respective initial spatial storage position of the coils in the coil store;

transporting a selected coil from an initial storage position to a processing machine for processing at least a portion of the sheet metal of the selected coil;

sensing a reduced diameter (D) of the selected coil after the portion of the sheet metal of the selected coil has been removed from the selected coil for processing by the processing machine;

storing the reduced diameter (D) of the selected coil;

transporting the selected coil having the reduced diameter (D) to a depositing storage position which, depending on the reduced diameter (D) of the selected coil, is selected to differ from the initial storage position in a manner that saves storage space such that a distance between a coil axis of the selected coil and a coil axis of a coil adjacent to the selected coil in the coil store is less in the depositing storage position than in the initial storage position; and storing the depositing storage position of the selected coil.

2. The method according to claim 1, characterised in that the transporting according to the transporting steps takes place by means of a coil transport device from which the portion of the sheet metal of the selected coil is unwound in the direction of the processing machine.

3. A combination of a processing machine and a coil store to keep a plurality of coils ready for processing the sheet metal of coils using the processing machine, comprising:

a holding device for holding all the coils in storage at any point in the holding device;

a memory device in which electronic data about an initial storage state can be stored, which electronic data contains information about a respective initial diameter ($D_A$) of the coils and a respective initial spatial storage position of the coils in the coil store;

a coil transport device for transporting a selected coil from an initial storage position at a first point on the holding device to the processing machine for processing at least a portion of the sheet metal of the selected coil, after which the selected coil has a reduced diameter (D), and for transporting the selected coil having the reduced diameter (D) to a second point on the holding device, which forms a depositing storage position and deviates from the first point on the holding device and, depending on the reduced diameter (D) of the selected coil is selected in a manner that saves storage space such that a distance between a coil axis of the selected coil and a coil axis of a coil adjacent to the selected coil in the coil store is less in the depositing storage position than in the initial storage position; and a sensor device for sensing the reduced diameter (D) of the selected coil after the portion of the sheet metal of the selected coil has been removed from the selected coil for processing by the processing machine.

4. The combination according to claim 3, characterised in that the coil transport device has an unwinding device for unwinding the portion of the sheet metal of the selected coil in the direction of the processing machine.

5. The combination according to claim 4, characterised in that the sensor device is arranged on the coil transport device.

6. The combination according to claim 3, characterised in that the holding device is formed by two elongated bearing supports, each having a horizontally extending upper edge, the bearing supports being spaced apart from one another in such a way that all the coils can be deposited at any desired point on the two upper edges to be kept ready for the processing machine.

7. The combination according to claim 6, characterised in that the sensor device is arranged on the coil transport device.

8. The combination according to claim 3, characterised in that the sensor device is arranged on the coil transport device.

* * * * *